United States Patent [19]

Ekholm

[11] 4,009,631

[45] Mar. 1, 1977

[54] DEVICE FOR HOLDING PIECES OF LUMBER WHEN THEY ARE CUT

[75] Inventor: Rolf Ekholm, Nyland, Sweden

[73] Assignee: AB Hammars Mekaniska Verkstad, Nyland, Sweden

[22] Filed: Sept. 19, 1975

[21] Appl. No.: 614,845

[30] Foreign Application Priority Data

Oct. 7, 1974 Sweden ..... 7412581

[52] U.S. Cl. ..... 83/375; 83/380; 83/390; 83/391; 83/461; 83/467 R; 83/485; 83/928

[51] Int. Cl.[2] ..... B27B 5/10; B27B 5/18; B26D 5/42

[58] Field of Search ..... 83/360, 375, 380, 390, 83/391, 461, 467, 468, 485, 928, 262

[56] References Cited

UNITED STATES PATENTS

| | | | |
|---|---|---|---|
| 1,262,943 | 4/1918 | Gustafson | 83/262 |
| 2,039,017 | 4/1936 | McLeod | 83/436 |
| 3,414,027 | 12/1968 | Larva et al. | 83/928 X |
| 3,570,349 | 3/1971 | Behrendt | 83/380 |

*Primary Examiner*—Donald R. Schran
*Attorney, Agent, or Firm*—Silverman & Cass, Ltd.

[57] ABSTRACT

A device for holding lumber to be cut including a conveyor system with an abutment plate and clamping arm to clamp the lumber against the plate. A saw is movable in a plane transverse to that of the conveyor to engage and cut the lumber at a side thereof opposite that engaged by the clamping arm.

6 Claims, 4 Drawing Figures

26
27
30
32
34
38
41
40
36
28
24

DEVICE FOR HOLDING PIECES OF LUMBER WHEN THEY ARE CUT

BACKGROUND OF THE INVENTION

The present invention relates to a device for holding pieces of lumber when they are cut by a movable saw means, preferably a saw blade.

It is an object of the present invention to provide an efficient device in which each separate part is simple and strong, said device being able to locate and hold pieces of lumber when they are cut at a high speed.

SUMMARY OF THE INVENTION

The invention is characterized by the fact that a conveyor, preferably comprising transport rollers, is arranged to support and feed a piece of lumber, with saw means being located at the lumber discharge end of said roller conveyor and movable in the transverse direction of the conveyor, and that at least one clamping arm is located ahead of said saw means in the feeding direction of a piece of lumber, said clamping arm being swingable in a vertical plane substantially parallel to the plane of the saw means and in a direction to and from an abutment, said abutment being located diametrically on the other side of a piece of lumber resting on said transport rollers. Furthermore, preferably a chain conveyor is located substantially parallel to and at one side of said roller conveyor, a plane, which is slightly inclined towards the roller conveyor is located between said conveyors, said plane preferably being provided with supporting ridges, and an end stop is provided at the end of the chain conveyor that is near the saw means, said end stop being adjustable in the longitudinal direction of the chain conveyor.

The invention will be illustrated by an embodiment shown as an example in the attached drawings.

DESCRIPTION OF THE PREFERRED EMBODIMENT

Figure 1:
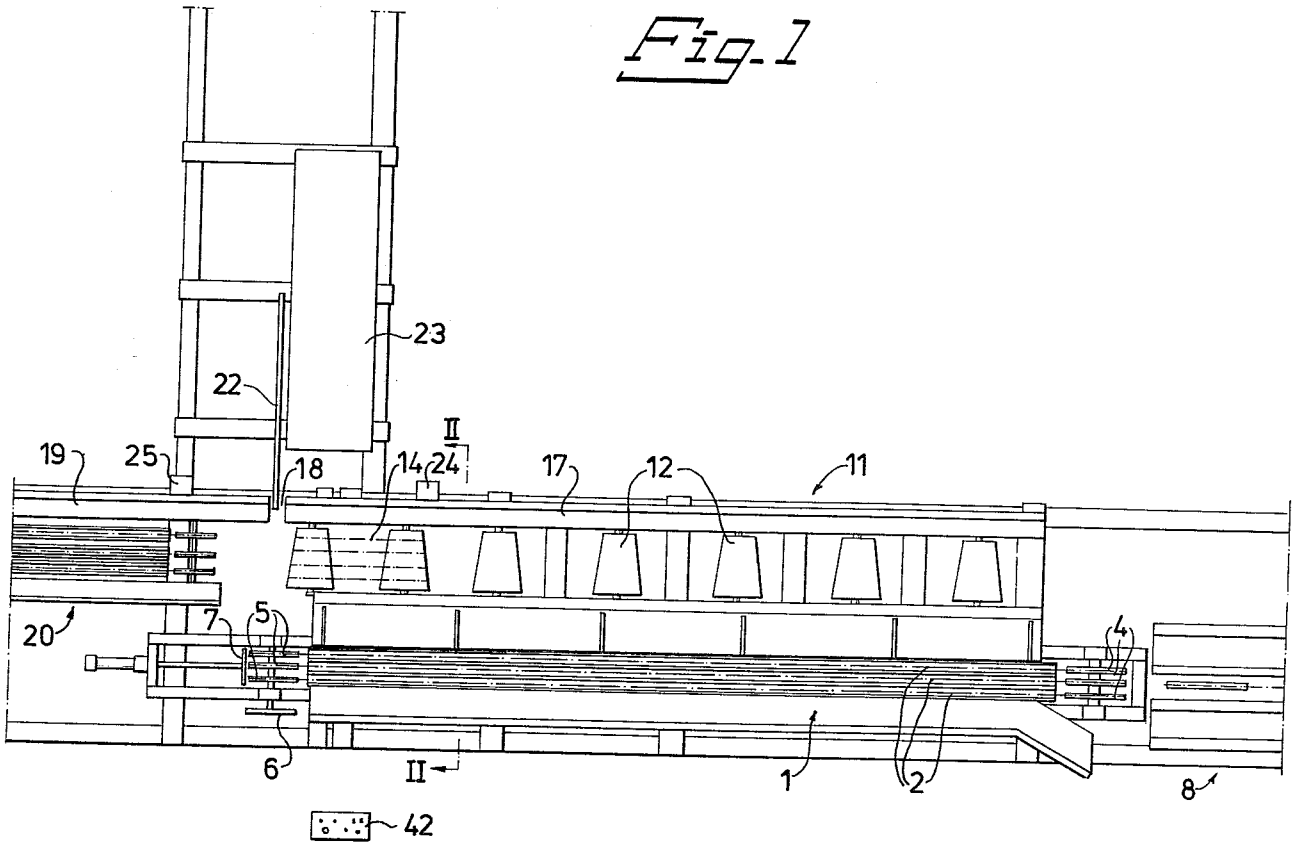
FIG. 1 is a somewhat schematical horizontal view of the device according to the invention.
Figure 2:
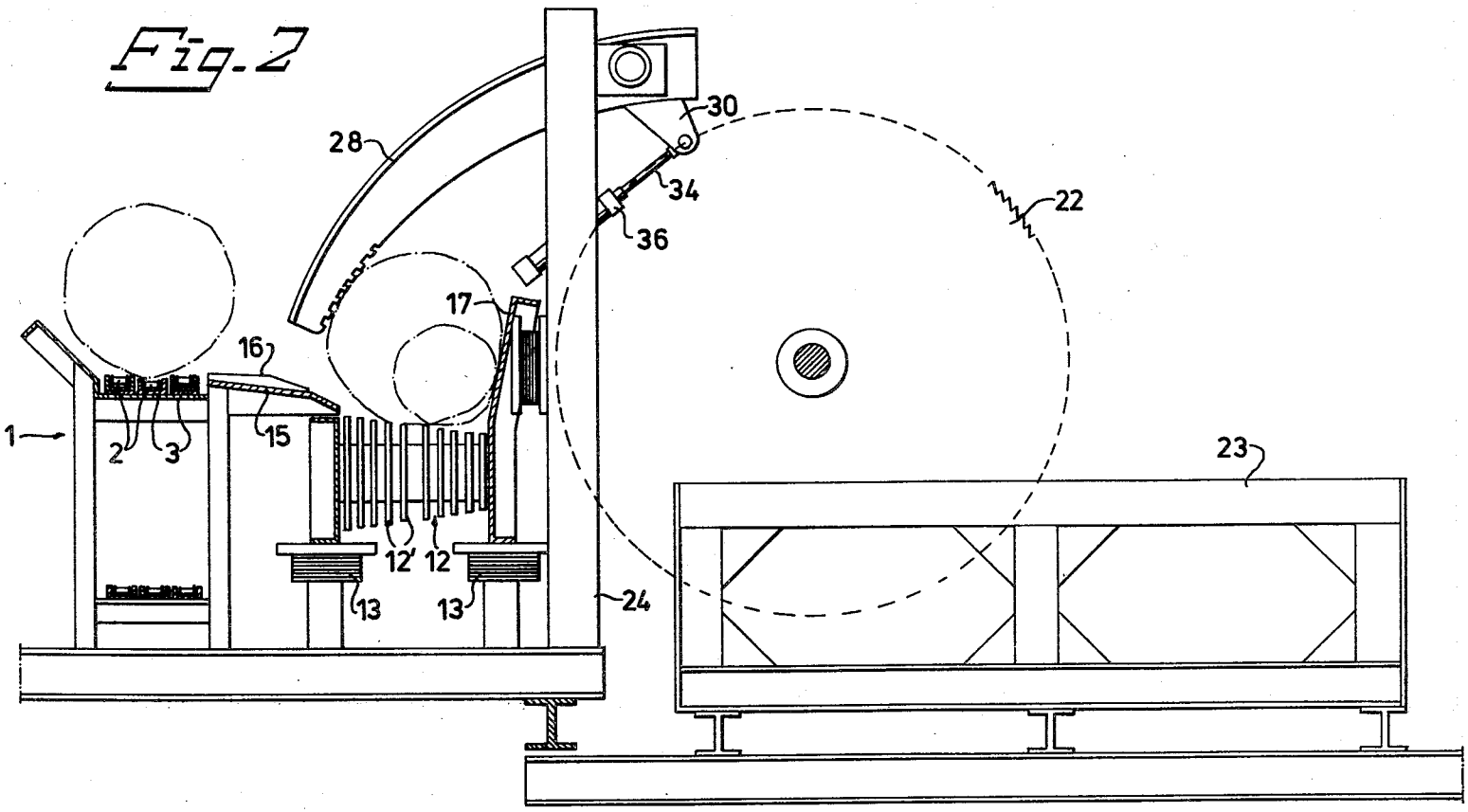
FIG. 2 is an enlarged sectional view taken along the line II—II in of FIG. 1. in the direction indicated generally.

The device in the drawings comprises a chain conveyor 1, see FIGS. 1 and 2, and endless chains 2 which run in U-shaped rails 3 and over chain wheels 4,5. The chain wheels 5 to the left in FIG. 1 are connected to a driving device, of which only a part 6 is illustrated. An end stop 7 is arranged adjustably in the longitudinal direction of the chain at the chain wheels 5. A longitudinal conveyor 8 is connected to the infeeding end of said chain conveyor 1, to the right in FIG. 1.

A roller conveyor 11 is located parallel to, and is nearly as long as, the chain conveyor 1, said roller conveyor 11 having a number of conical rollers 12, each of which is formed with a number of spaced discs 12' with slightly tooth-shaped peripheries, see FIG. 2. Said rollers 12 are supported by shock absorbers 13. An endless chain 14 runs over the two leftmost rollers in FIG. 1 on, for example, every third disc 12'. The rollers are mechanically driven at the same speed.

A plane 15 slightly inclined towards the bases of the rollers 12 is arranged between the chain conveyor 1 and the roller conveyor 11, said plane 15 having supporting ridges 16 on its upper side. A nearly vertical abutment plate 17 is located along that side of the roller conveyor which is opposite to the plane 15.

An abutment plate 19 of the same construction and disposition as the firstmentioned abutment plate 17 is positioned with a gap 18 between the plates. A further chain conveyor 20 is arranged close to said abutment plate 19 and in continuation of the roller conveyor 11. Conveyor 20 has a longitudinally adjustable end stop, which forms no part of the present invention and is therefore not shown in FIG. 1. In said figure only a part of the abutment plate 19 and of the further chain conveyor 20 are shown, and these parts are preferably substantially shorter than the roller conveyor 11.

A saw blade 22 is located at the discharge end of the roller conveyor 11. The plane of blade 22 is located in the transverse direction of the roller conveyor, and the blade is displaceable in its own plane and supported by a frame 23.

Figure 3:
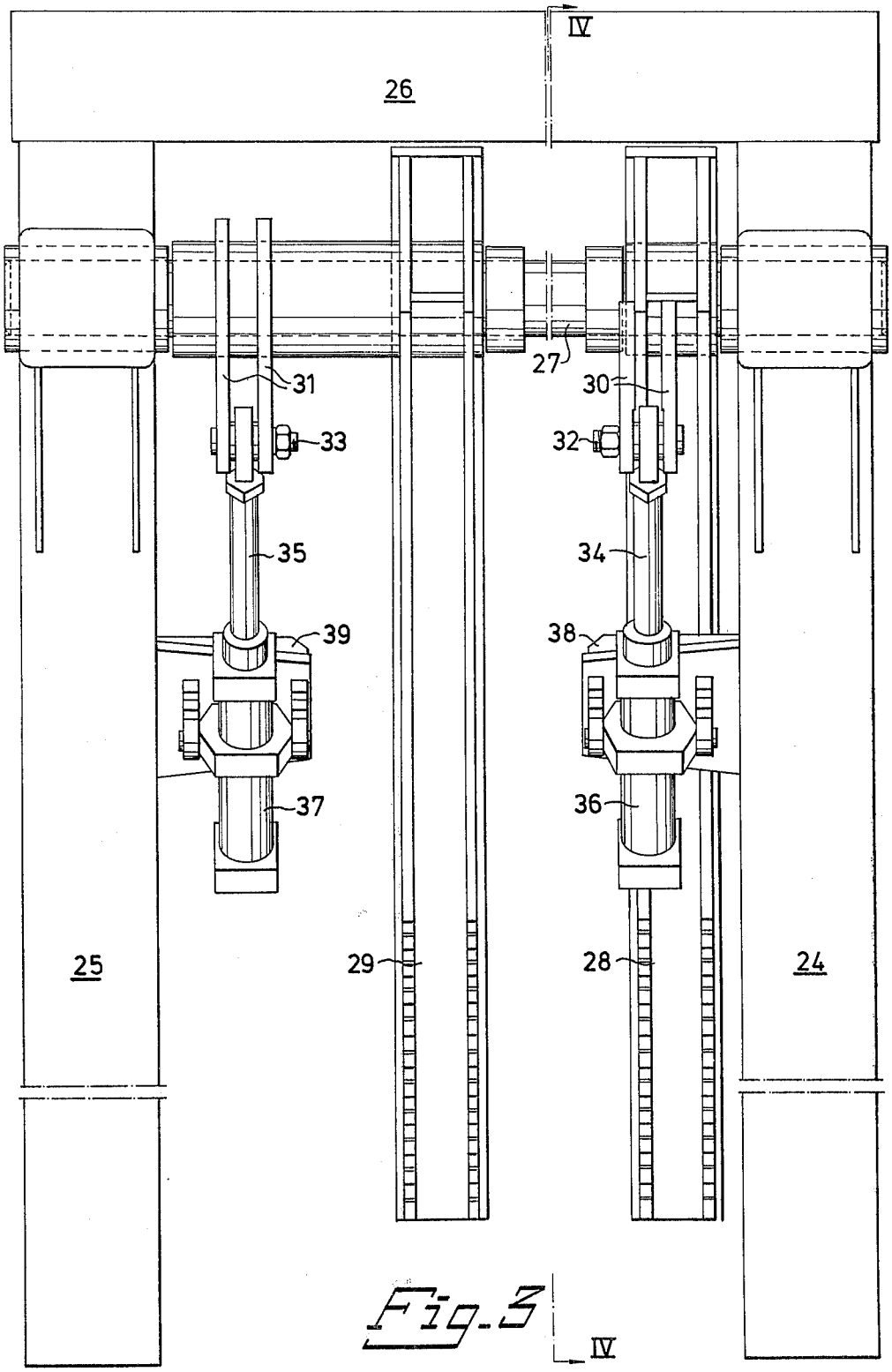
FIG. 3 is an enlarged view of a clamping arm device forming a part of the device of the invention.
Figure 4:
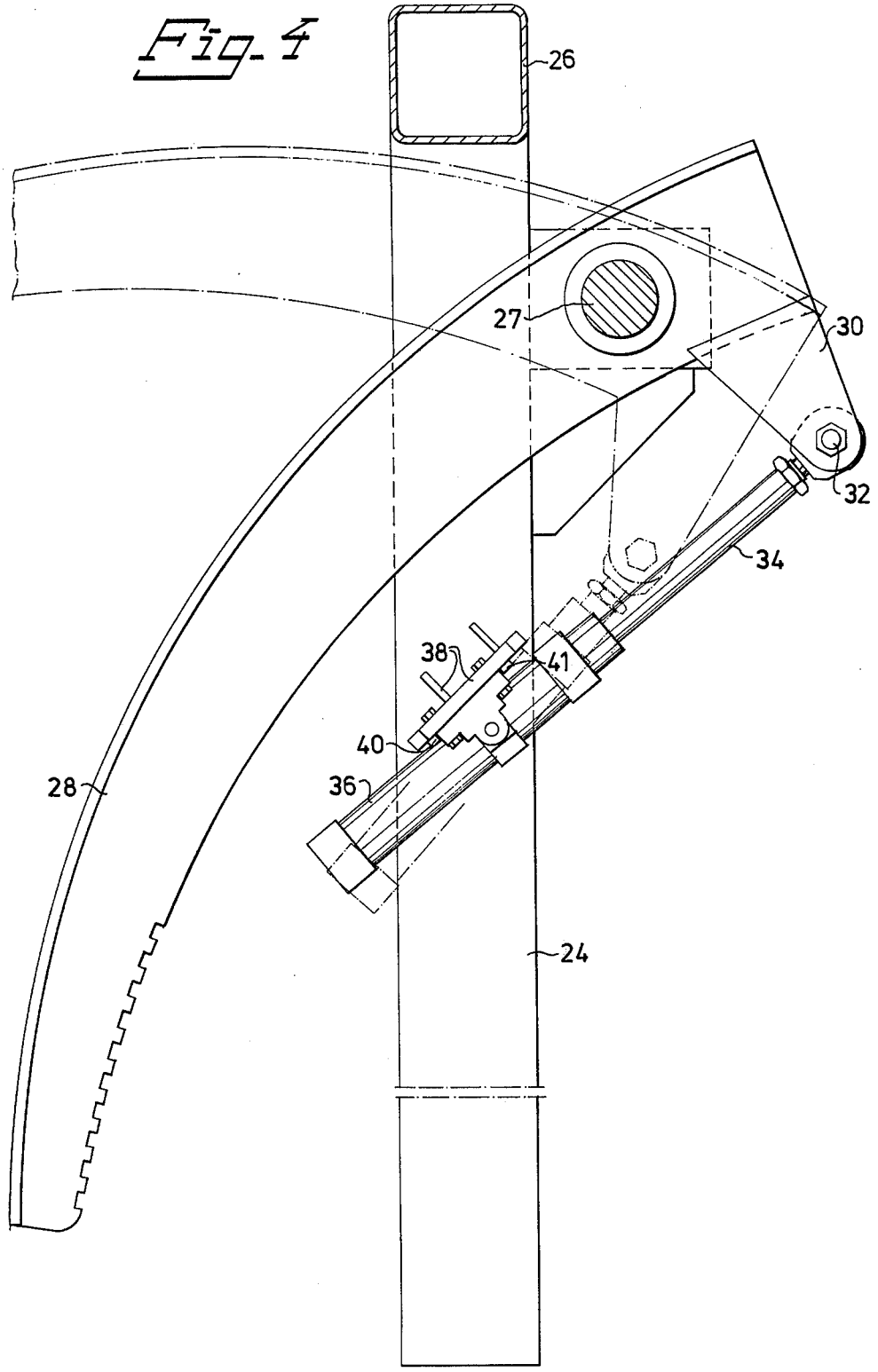
FIG. 4 is a vertical sectional view taken along the line IV—IV of FIG. 3 in the direction indicated generally.

A pair of square pillars 24,25 are located at each side of the saw blade 22, said pillars being connected to each other at their upper ends by a cross beam 26, see FIG. 3. Said pillars 24,25 carry between them a preferably fixed shaft 27. A pair of clamping arms 28,29 are swingably journalled on said shaft 27 in planes that are parallel to the saw blade 22. The clamping arms 28,29 are long enough to hold a piece of lumber between their toothed, free ends and an abutment plate 17 or 19 respectively, as will be closer explained below. Each clamping arm 28,29 is provided with beaming brackets 30 and 31 respectively close to the shaft 27, each of said bearing brackets 30,31 being swingably connected by a pivot pin 32,33 to piston rod 34,35 each in hydraulic cylinders 36 and 37 respectively. Said hydraulic cylinders are swingably supported by brackets 38,39, each of which is fastened to a pillar 24,25. Stops are arranged on both brackets 38,39 to limit the swinging movement of the cylinders. However, only the stops 40,41 located on the bracket 36 are shown in the drawings. The hydraulic piston-cylinder-device 34,36 and 35,37 is operable to swing clamping arms 28,29 between the positions shown in FIG. 4 by full and dash-and-dot lines.

In the hydraulic systems of the cylinders 36,37 there is provided a pressure indicating means or the like, which indicates when a clamping arm has reached its clamping position on a piece of lumber by the pressure of the respective pressure indicating means rising. From said pressure indicating means an impulse will be transmitted to the saw blade supporting means to start the movement of the saw blade against the piece of lumber. Furthermore, there is a position indicating means (not shown) at each clamping arm in order transmitting connection with the saw blade supporting means. Said indicating means registers for example two different positions of the arm, i.e. when the clamping arm is in a position for clamping pieces of lumber of for example up to 300 mm diameter of or up to 750 mm diameter. In both cases the position indicating means will give an order to the saw blade supporting means to move the saw blade a distance long enough that a piece of lumber of 300 or 750 mm diameter will be cut off.

A control desk 42 is located preferably at the side of the chain conveyor 1 for controlling the whole clamping device.

The function and advantages of the device will be described below. One piece of lumber at a time is transported to the chain conveyor 1. Said chain conveyor 1 will feed the piece of lumber, which is indicated by dash-and-dot lines in FIG. 2, against the end stop 7, the position of which is adjusted with regard to the length of the end piece that is to be cut off. Thereafter the piece of lumber will be tilted over the supporting plane 15 and its supporting ridges 16 down to the rollers 12 which are stopped. The clamping arm 28 will clamp the piece of lumber against the conical rollers 12 and the abutment plate 17. The pressure indicating means of the hydraulic system of the clamping arm 28 gives an order to the supporting means of the saw blade 22 to start the movement of the saw blade against the piece of lumber. At the same time the position indicating means of the clamping arm gives an order to said supporting means to move a distance that is long enough for the saw blade to cut through the piece of lumber, i.e. a certain distance if the diameter of the piece of lumber is not greater than 300 mm, and a longer distance if the diameter of the piece of lumber exceeds 300 mm. Hereby unnecessary movement lengths of the saw blade will be avoided, whereby time will be gained and unnecessary energy losses prevented.

After the end cut described above the clamping arm 28 will be swung up and the piece of lumber will be fed forward by the rollers 12 to an end stop not shown located on the chain conveyor 20, the position of said end stop depending on the length of the piece to be cut. Preferably both the clamping arms 28,29 now hold the piece of lumber, and the procedure of the succeeding cut will be the same as described above. The pressure of the clamping arms is about diametrically directed relative to the operation direction of the saw blade on the piece of lumber. This has the advantage, if the pieces of lumber are conically shaped with slightly concave mantle surfaces and axial surface lines on the piece of lumber will be concave, that the cut will be widened during the cutting so that the saw blade will not stick in the cut. The cut off piece is removed and the piece of lumber will be fed forward so that further pieces can be cut off, until the last cut is to be made near the end of the piece of lumber. If the piece of lumber then has passed the clamping arm 28 and thus can not be clamped by said arm, as is often the case, the other clamping arm 29 can alone steadily hold the piece of lumber. If the cut off end of the piece of lumber tends to be left between the two near transport rollers, it will be caught by the chains 14 and removed. Thus the whole device can receive, hold and cut pieces of lumber into shorter pieces at a high speed.

The invention is not restricted to the embodiment described and shown in the drawings, as it can be varied within the scope of the invention. The clamping arms can for example work on the undersides and the abutment can be located at the upper sides of the pieces of lumber. There may be provided only one clamping arm located before the saw blade. The cutting means can be of some other kind than a saw blade. The construction and shapes of the different details may be varied.

What I claim is:

1. A device for holding pieces of lumber to be cut by movable saw means comprising, a saw blade, a conveyor including transport rollers arranged to support and feed a piece of lumber to a discharge end of the conveyor, said saw means being positioned at said discharge end and movable in a plane transverse to that of the conveyor, at least one clamping arm positioned ahead of said saw means along the feeding direction of the piece of lumber, at least one generally vertical abutment plate positioned for supportive engagement of said lumber disposed on said conveyor, said clamping arm being swingable in a vertical plane substantially parallel to the plane of movement of the saw means in a direction to and from said abutment plate to clamp and engage the lumber against the abutment plate, said saw blade being movable to a cutting position at a side of the piece of lumber which is opposite to that side engaged by said clamping arm.

2. A device as claimed in claim 1 in which said transport rollers are of generally conical configuration and are formed by a plurality of spaced discs, said one abutment plate being positioned adjacent said conveyor above the circumferential extremities of said rollers and to one side of the path of movement of said saw means, a second generally vertical abutment plate positioned adjacent said one plate but spaced therefrom and disposed on the other side of the path of movement of said saw means.

3. A device as claimed in claim 1 in which there is a second clamping arm and said arms are positioned on opposite sides of the path of movement of said saw means.

4. A device as claimed in claim 3 in which each clamping arm is supported by a respective pillar, a shaft positioned between the pillars and the arms being journaled on the shaft for swinging movement thereof between certain limits, said clamping arms including respective bearing brackets and each bracket mounted in a hydraulic cylinder for articulating movement on a respective piston roll, each cylinder being journaled in a respective bracket carried by a respective pillar for swinging movement within certain limits.

5. A device as claimed in claim 4 including control means associated with the hydraulic cylinders, said control means including pressure indicating means arranged to transmit an impulse to start movement of said saw means when each clamping arm is engaged at a certain pressure against the piece of lumber.

6. A device as claimed in claim 3 including means to indicate at least two clamping positions of said arms, said last named means arranged to transmit to the saw means indication of said clamping positions so as to control movement of the saw means.

* * * * *